US005893422A

United States Patent [19]

Huang

[11] Patent Number: 5,893,422

[45] Date of Patent: Apr. 13, 1999

[54] ROTATING TOOL

[76] Inventor: Chin-Tan Huang, No. 39, Lane 240, Li-Jih Road, Ta-Li City, Taichung Hsien, Taiwan

[21] Appl. No.: 09/046,764

[22] Filed: Mar. 24, 1998

[51] Int. Cl.[6] ..... B25B 17/00

[52] U.S. Cl. ..... 173/216; 173/48; 81/57.22; 81/57.29

[58] Field of Search ..... 173/48, 216, 171; 81/57, 57.22, 57.29, 57.13, 58.1

[56] References Cited

U.S. PATENT DOCUMENTS

| | | | |
|---|---|---|---|
| 873,771 | 12/1907 | McCoy | 81/57.29 |
| 2,310,759 | 2/1943 | Clawson | 173/216 |
| 3,267,776 | 8/1966 | Watson | 81/57.29 |
| 3,971,271 | 7/1976 | Wagner, Jr. et al. | 81/57.29 |
| 4,217,964 | 8/1980 | Eaton | 173/216 |
| 4,258,594 | 3/1981 | Welch | 81/57.29 |
| 4,799,407 | 1/1989 | Miyamoto | 81/58.1 |

*Primary Examiner*—Scott A. Smith
*Attorney, Agent, or Firm*—Rosenberg, Klein & Bilker

[57] ABSTRACT

A rotating tool is disclosed. It includes a main body, a rotating wheel and a transmission shaft. A diaphragm is formed in the main body for fixing the rotating wheel. The rotating wheel cooperates with idlersand gears for increasing rotating speed. Two bevel gears serve to change the operation direction. Therefore, an operator can depress a grip with one hand and rotate a handle with the other hand to enhance convenience in use and increase the speed of operation.

3 Claims, 5 Drawing Sheets

ROTATING TOOL

BACKGROUND OF THE INVENTION

The present invention relates to a rotating tool, and more particularly to a tool which meets the requirement of using attitude of an operator.

A traditional screwdriver (not shown) is used to rotate a screw (not shown). Even the screwdriver is equipped with a ratchet mechanism and has one-way driving function, such screwdriver still can hardly quickly screw in or unscrew out the screw. In practice, a considerably long section of the screw can be quickly rotated without using much strength and only a short section of the screw necessitates greater strength. Therefore, it is necessary to develop a rotating tool which not only is able to quickly rotate the screw or the like, but also can provide greater torque so as to increase working efficiency.

SUMMARY OF THE INVENTION

In order to obviate the above problem, it is a primary object of the present invention to provide a rotating tool including a rotating wheel disposed on one side of a main body. An operator can depress a grip with one hand and rotate a handle with the other hand to enhance convenience in use and increase the speed of operation.

The present invention can be best understood through the following description and accompanying drawings, wherein:

DETAILED DESCRIPTION OF THE PREFERRED EMBODIMENT

Figure 1:
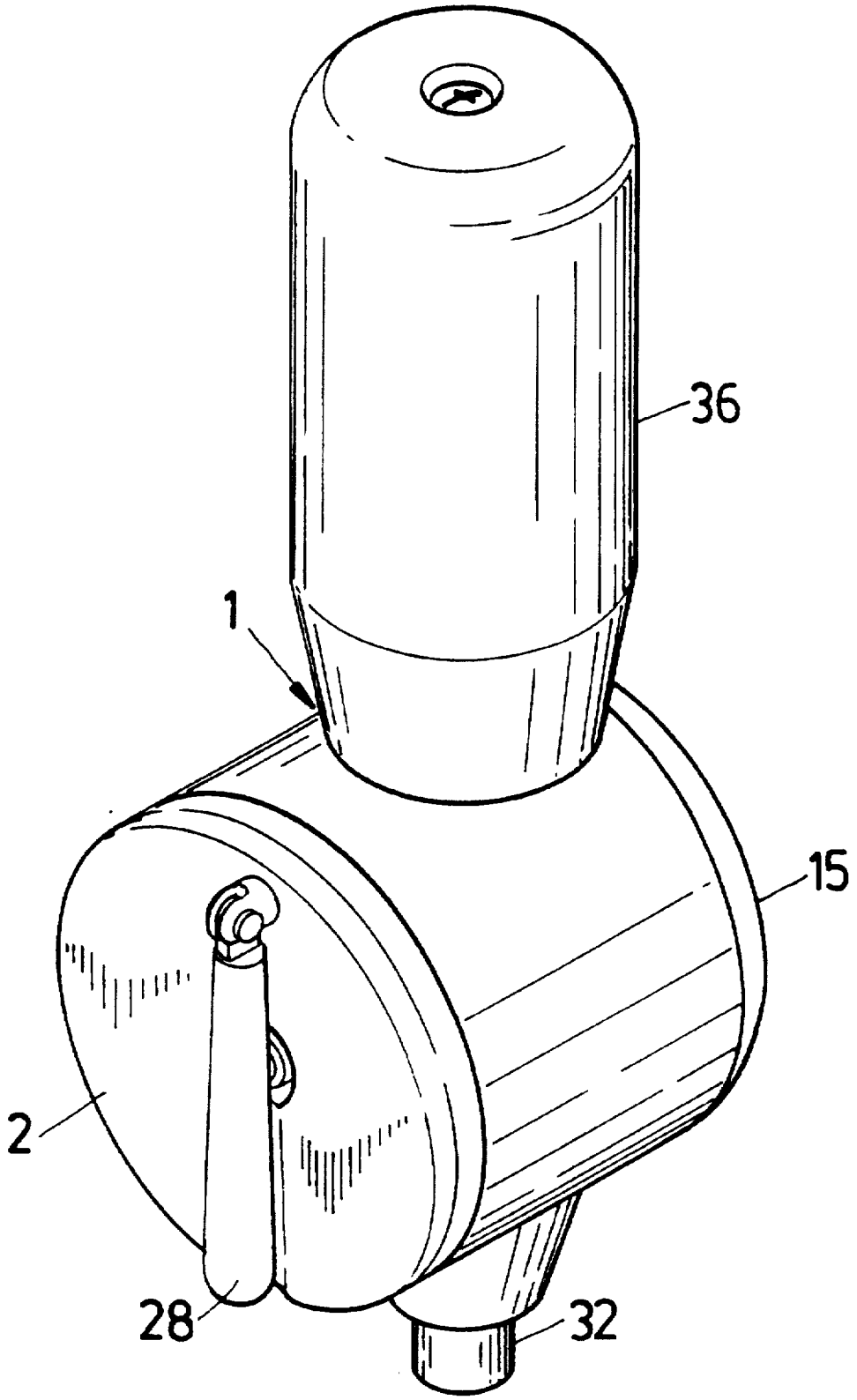
FIG. 1 is a perspective assembled view of the present invention.

Please refer to FIGS. 1 to 5. The present invention includes:

a main body 1 formed as a transverse cylindrical body, one side of the interior of the main body 1 being formed with a vertical diaphragm 11 dividing the interior into two sections, the diaphragm 11 being formed with a central locating through hole 111, two opposite sides of the locating hole 111 being respectively formed with two through holes 112, a bottom of the main body being formed with a pivot hole 12 communicating with the interior of the main body, a top of the main body 1 being formed with a slide through hole 13 coaxial with the pivot hole 12, two opposite sides of outer face of the peripheral wall of the slide hole 13 being respectively formed with a large cut section 131 and a small cut section 132, one end of the main body distal from the diaphragm 11 being fitted with a cover body 15;

a rotating wheel 2 disposed in on outer side of the diaphragm 11 in the main body 1, the periphery of inner face of the rotating wheel 2 being disposed with multiple inner teeth 21 meshing with idlers 23 respectively rotatably disposed at the through holes 112 via rivets 22, the idlers 23 meshing with the same gear 24 fixedly fitted on a rotary shaft 25, the rotary shaft 25 being rotatably fitted in the locating hole 111, one end of the rotary shaft 25 via a latch ring 26 restricting the travel of the rotating wheel 2, the other end of the rotary shaft 25 having a first bevel gear 27, a handle 28 being disposed on outer face of the rotating wheel 2 for rotating the same; and a transmission shaft 3 disposed in the main body 1, the transmission shaft being a rod member having a hexagonal cross-section, a lower section of the transmission shaft 3 being a fitting section 31 having a circular cross-section, the fitting section 31 being detachably fitted with a connecting rod 32, a bottom of the connecting rod 32 being fitted with a screwdriver head 16 or a drill head 17, the connecting rod 32 being rotatably fitted in the pivot hole 12, a top end of the connecting rod 32 being formed with a coaxial hexagonal fitting hole 321, a lower section of the fitting hole 321 being a circular hole 322 corresponding to the fitting section 31, a middle section of the connecting rod 32 being fitted with a second bevel gear 33 meshing with the first bevel gear 27, an upper section of the transmission shaft 3 being a pushing section 34 abutting against a spring 35 disposed in the slide hole 13, a top end of the pushing section 34 being disposed with a grip 36, a bottom of the grip 36 being formed with an upward extending cavity 361, two opposite sides of the cavity 361 being respectively formed with a large and a small projections 362, 363.

Figure 4:
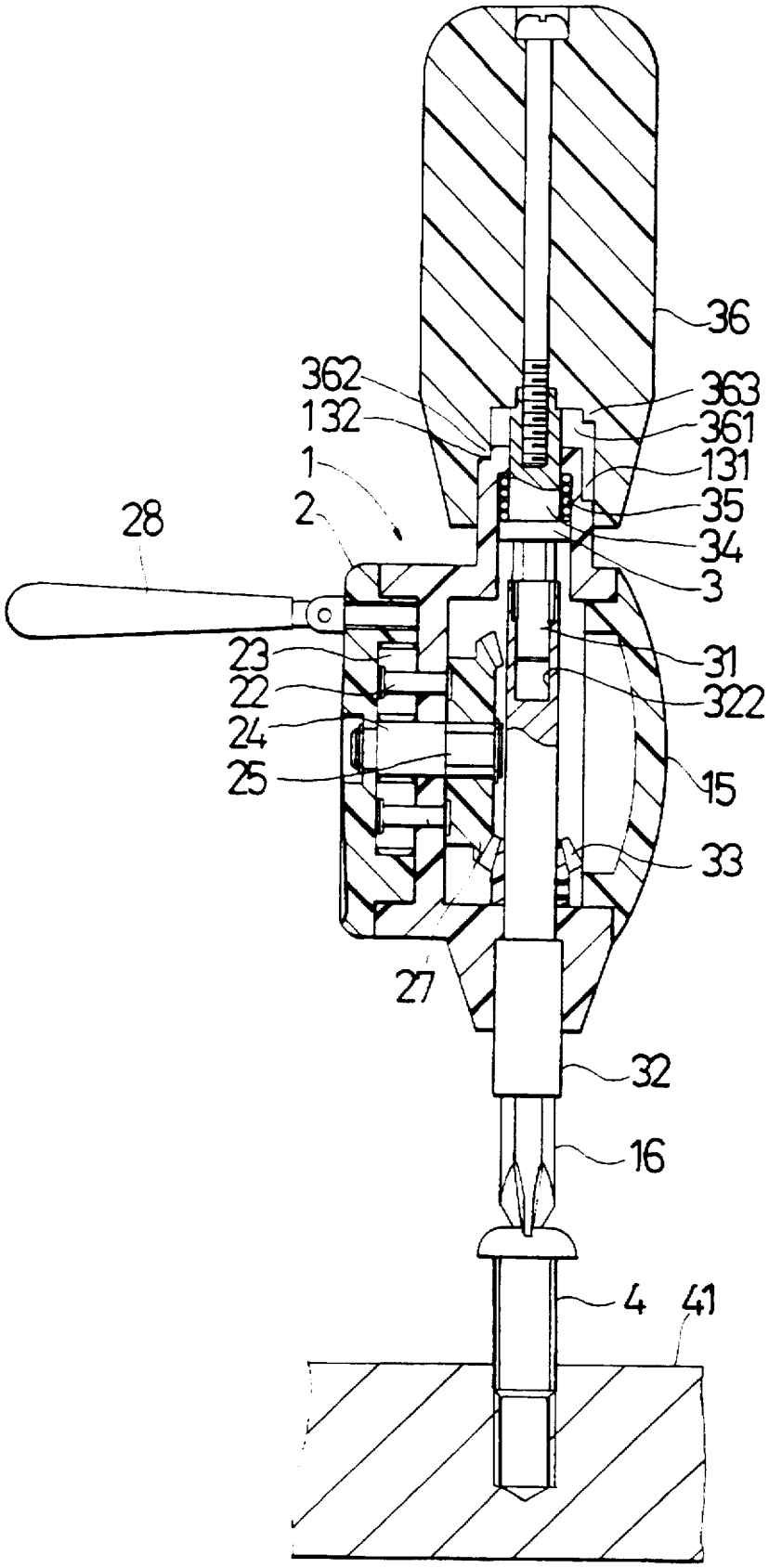
FIG. 4 is a sectional view of the present invention, showing the operation thereof in one state.
Figure 5:
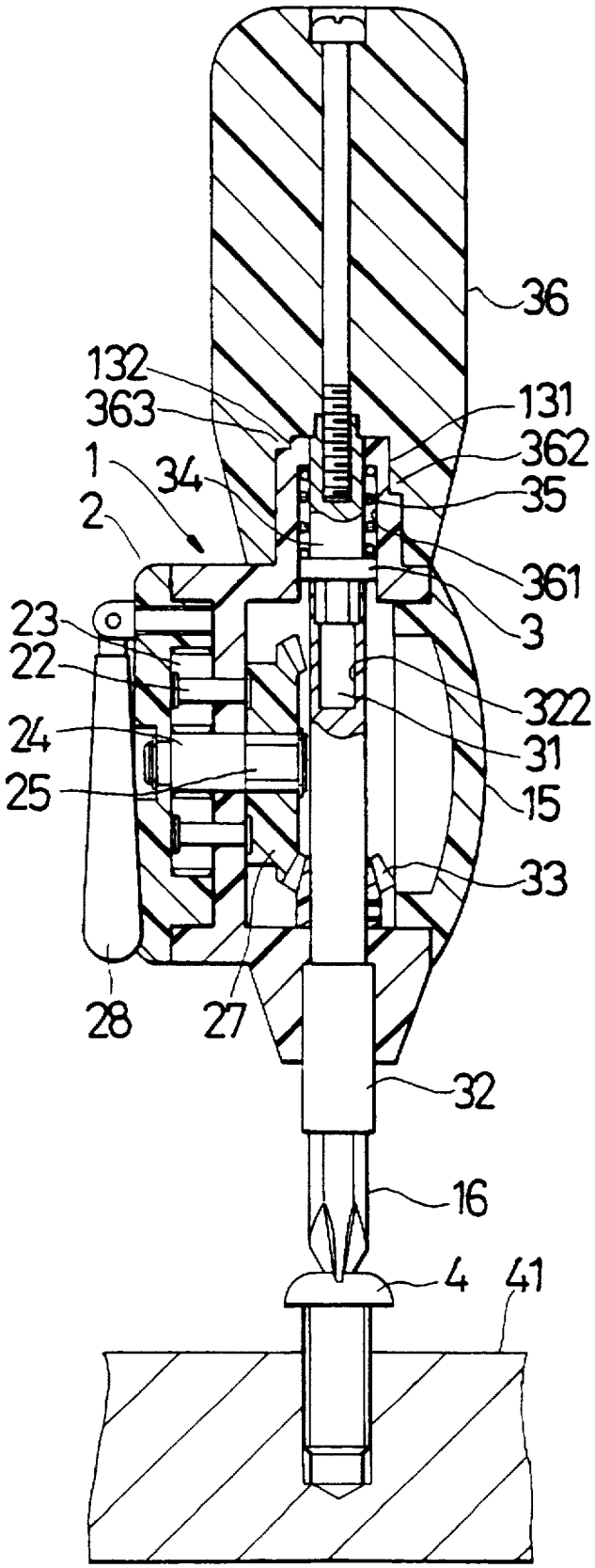
FIG. 5 is a sectional view of the present invention, showing the operation thereof in another state.

Referring to FIGS. 4 and 5, in use, a suitable screwdriver head 16 or drill head 17 is selected to connect with the connecting rod 32. Then the screwdriver head 16 is aimed at a screw 4 to be tightened or untightened. At the beginning of tightening, the tightness between the screw 4 and the work piece 41 is less. Under such circumstance, an operator can pull up the grip 36 and rotate the same through 180 degrees, making the large projection 362 engaged in the small cut section 132. At this time, the transmission shaft 3 is fixed on upper side and the fitting section 31 of the transmission shaft 3 is separated from the fitting hole 321 of the connecting rod 32 as shown in FIG. 4. Then the handle 28 is rotated, making the rotating wheel 2 simultaneously drive the two idlers 23 to rotate. The idlers 23 in turn drive the gear 24 and the rotary shaft 25 to rotate. The number of the inner teeth 21 of the rotating wheel 2 is much more than the tooth number of the gear 24, so that the rotating speed of the rotary shaft 25 can be greatly increased. The first bevel gear 27 of the rotary shaft 25 further drives the second bevel gear 33, whereby the connecting rod 32 associated with therewith is also rotated. Therefore, the connecting rod 32 is rotated also at a very quick speed. Accordingly, the operator can quickly screw in the screw 4.

When the tightness between the screw 4 and the work piece 41 starts to increase, the operator will feel that the force exerted onto the screw 4 is insufficient. At this time, the operator can rotate the grip 36 back to the original angle, making the large projection 362 engaged in the large cut section 131 and the small projection 363 engaged in the small cut section 132. Also, the cavity 361 is fitted around the slide hole 13. Under such circumstance, the transmission shaft 3 is pushed by the spring 35 back to its home position and the fitting section 31 is fitted into the fitting hole 321 of the connecting rod 32 as shown in FIG. 5. Accordingly, the connecting rod 32 is fixed and the operator can then rotate the grip 36 to rotate the connecting rod 32 and the screwdriver head 16. Therefore, a greater torque is exerted onto the screw 4 to tighten the same. In this state, the rotating speed is not increased so that the torque is not reduced and the screw 4 can be effectively tightened.

Figure 2:
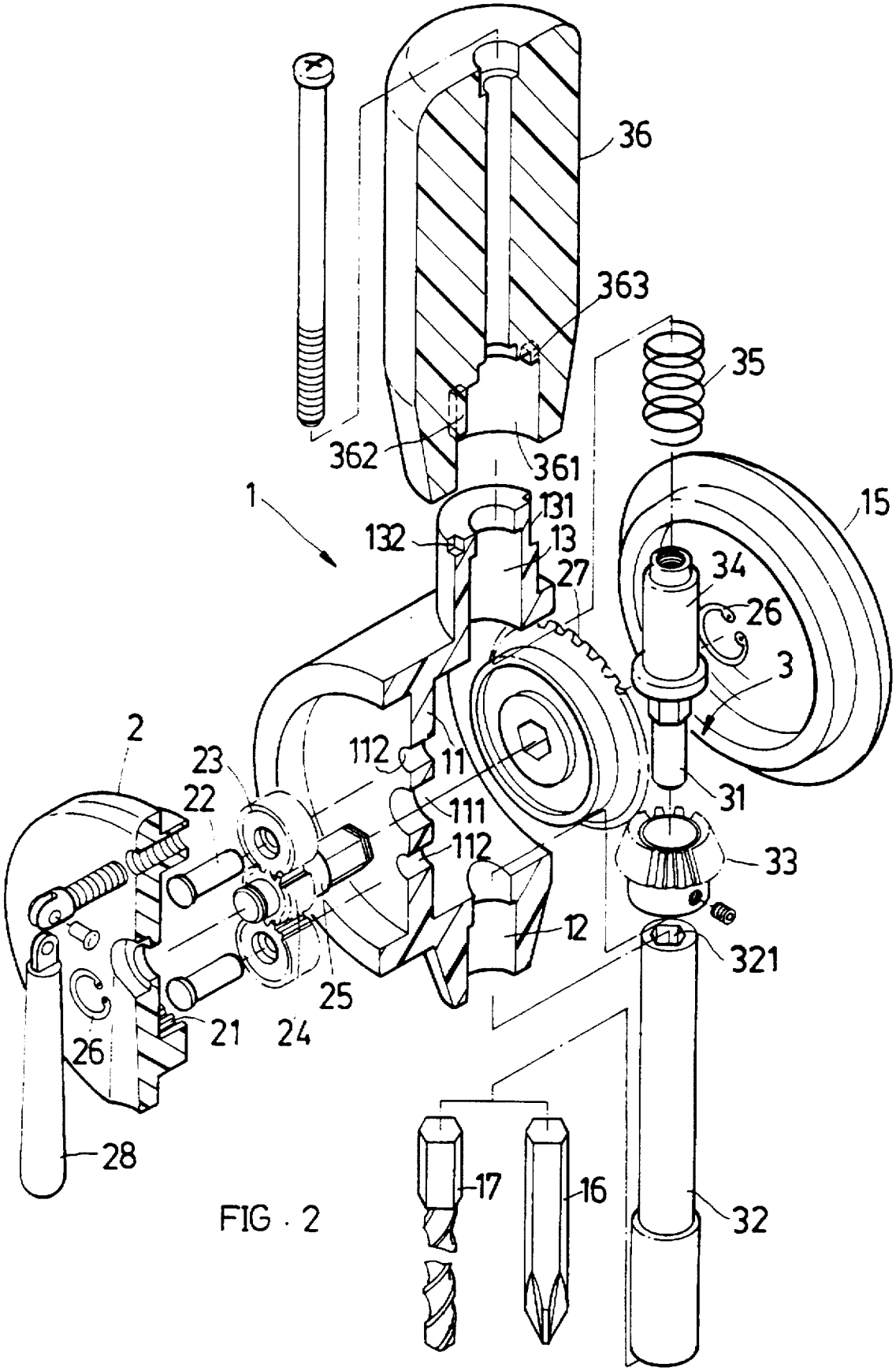
FIG. 2 is a perspective exploded view of the present invention.
Figure 3:
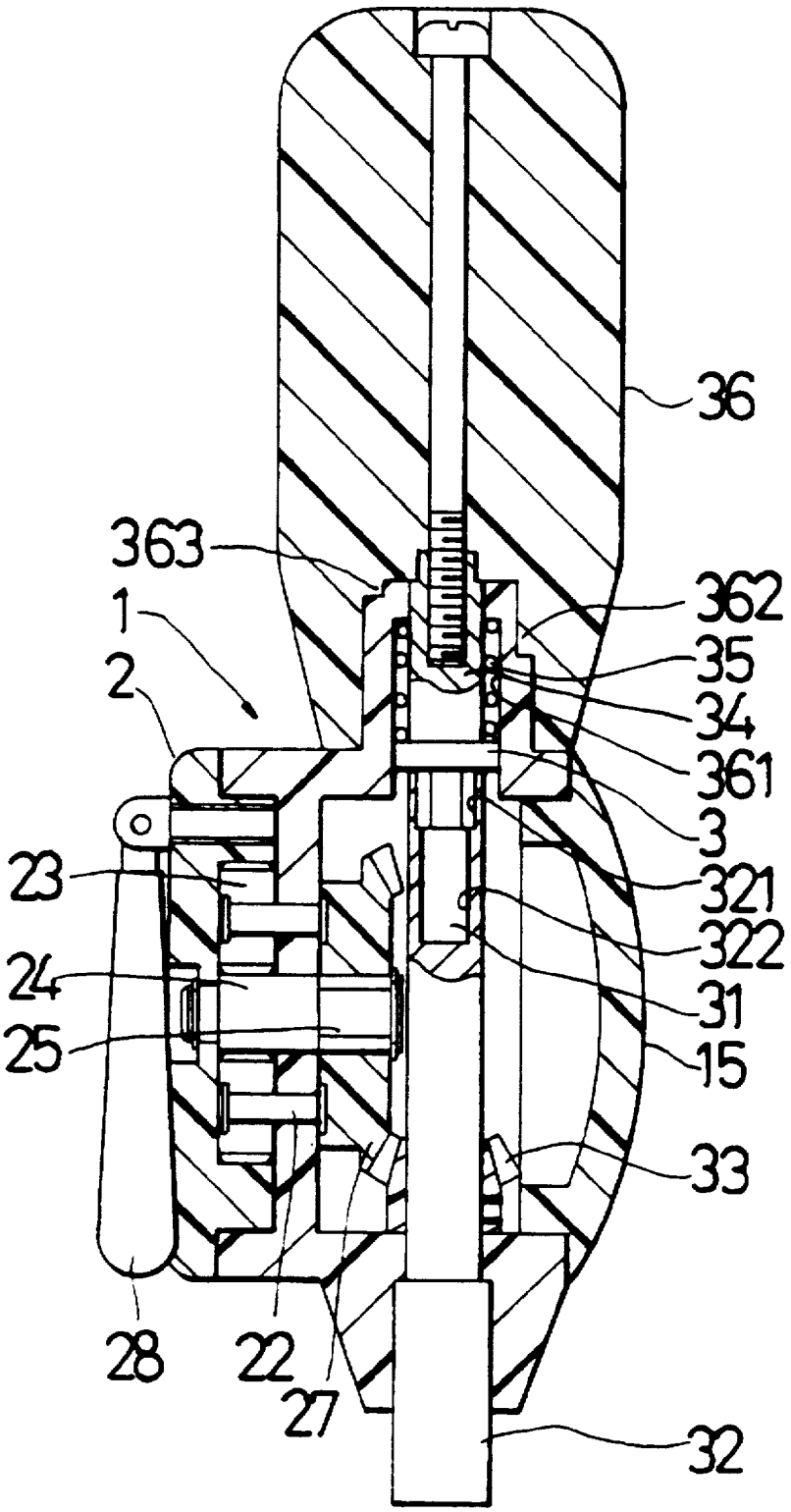
FIG. 3 is a sectional view of the present invention.

According to the above arrangement, when it is desired to quickly screw in the screw, the operator can depress the grip 36 with one hand and rotate the handle 28 with the other hand. The handle 28 is operated in a direction in accordance with the operation direction of the operator's hand, so that the handle 28 can be easily operated. Therefore, the convenience in use and the operation speed are enhanced. The application of the present invention is not limited to tightening of screw. As shown in FIG. 2, the present invention is also applicable to the drill head 17 and other fields.

It is to be understood that the above description and drawings are only used for illustrating one embodiment of the present invention, not intended to limit the scope thereof. Any variation and derivation from the above description and drawings should be included in the scope of the present invention.

What is claimed is:

1. A rotating tool comprising:

a main body formed as a transverse cylindrical body, one side of an interior of the main body being formed with a vertical diaphragm, the diaphragm being formed with a central through locating hole, a bottom of the main body being formed with a pivot hole communicating with the interior of the main body, a top of the main body being formed with a slide through hole coaxial with the pivot hole, at least one cut section being formed on an outer face of a peripheral wall of the slide hole;

a rotating wheel disposed in an outer side of the diaphragm in the main body, a periphery of an inner face of the rotating wheel being disposed with multiple inner teeth meshing with idlers rotatably disposed on the diaphragm, the idlers meshing with a gear fixedly fitted on a rotary shaft, the rotary shaft being rotatably fitted in the locating hole, one end of the rotary shaft having a first bevel gear, a handle being disposed on an outer face of the rotating wheel for rotating the same; and a transmission shaft disposed in the main body, the transmission shaft being a rod member having a polygonal cross-section, a lower section of the transmission shaft being a fitting section having a circular cross-section, the fitting section being detachably fitted with a connecting rod for connecting with a tool head, the connecting rod being rotatably fitted in the pivot hole, a top end of the connecting rod being formed with a coaxial polygonal fitting hole, a middle section of the connecting rod being fitted with a second bevel gear meshing with the first bevel gear, an upper section of the transmission shaft being a pushing section abutting against a spring disposed in the slide hole, a top end of the pushing section being disposed with a grip positioned on an outer side of the main body, a bottom of the grip being formed with an upward extending cavity, at least one projection being formed on an inner wall of the cavity, the at least one projection being shaped corresponding to the at least one cut section for engaging therewith.

2. A rotating tool as claimed in claim 1, wherein the rotary shaft via a latch ring restricts a travel of the rotating wheel.

3. A rotating tool as claimed in claim 1, wherein a lower section of the fitting hole is a circular hole for fitting with the fitting section.

* * * * *